United States Patent [19]

Gerber

[11] 4,356,257

[45] Oct. 26, 1982

[54] PHOTOSENSITIVE SILVER HALIDE ELEMENT AND METHOD OF PREPARING SAME

[75] Inventor: Arthur M. Gerber, Boston, Mass.

[73] Assignee: Polaroid Corporation, Cambridge, Mass.

[21] Appl. No.: 298,640

[22] Filed: Sep. 2, 1981

[51] Int. Cl.[3] ..... G03C 1/02

[52] U.S. Cl. ..... 430/496; 430/567; 430/569; 430/568

[58] Field of Search ..... 430/495, 496, 564, 567, 430/568, 569, 948

[56] References Cited

U.S. PATENT DOCUMENTS

| | | | |
|---|---|---|---|
| 3,219,451 | 11/1965 | LuValle et al. | 430/932 |
| 3,320,069 | 5/1967 | Illingsworth et al. | 430/603 |
| 4,046,576 | 9/1977 | Terwilliger et al. | 430/569 |
| 4,150,994 | 4/1979 | Maternaghan | 430/567 |

FOREIGN PATENT DOCUMENTS

WO80/01614 8/1980 PCT Int'l Appl. .

OTHER PUBLICATIONS

Duffin, Photographic Emulsion Chemistry, 1966, p. 59.

*Primary Examiner*—Mary F. Downey
*Attorney, Agent, or Firm*—Philip G. Kiely

[57] ABSTRACT

A method for forming a photosensitive element comprising a plurality of single effective siler halide grains in a predetermined spaced array which comprises coalescing fine-grain silver halide in a plurality of predetermined spaced depressions in a surface, thereby forming in situ a single effective silver halide grain in each of said depressions and a photosensitive element comprising coalesced single effective silver halide grains in a predetermined spaced array.

36 Claims, 21 Drawing Figures

1μm

1μm

1μm

1μm

1μm

1μm

1 μm

1 μm

1μm

1000X

1μm

1μm

PHOTOSENSITIVE SILVER HALIDE ELEMENT AND METHOD OF PREPARING SAME

BACKGROUND OF THE INVENTION

In the formation of photosensitive silver halide emulsions, the ripening or growing step during which time the silver halide grains grow is considered important. During the ripening stage an adequate concentration of a silver halide solvent, for example, excess halide, generally bromide, is employed which renders the silver halide much more soluble than it is in pure water because of the formation of complex ions. This facilitates the growth of the silver halide grains. While excess bromide and ammonia are the most common ripening agents, the literature also mentions the use of water-soluble thiocyanate compounds in place of bromide as well as a variety of amines. See, for example, *Photographic Emulsion Chemistry*, G. F. Duffin, The Focal Press London, 1966, page 59.

The art has also disclosed the employment of a water-soluble thiocyanate compound as being present during the formation of the grains, that is, during the actual precipitation of the photosensitive silver halide. For example, U.S. Pat. No. 3,320,069 discloses a water-soluble thiocyanate compound which is present as a silver halide grain ripener either during precipitation of the light sensitive silver halide or added immediately after precipitation. The precipitation of the silver halide grains in the aforementioned patent is carried out, however, with an excess of halide.

U.S. Pat. No. 4,046,576 is directed to a method for the continuous formation of photosensitive silver halide emulsions wherein a silver salt is reacted with a halide salt in the presence of gelatin to form a photosensitive silver halide emulsion and said formation takes place in the presence of a sulfur-containing silver halide grain ripening agent, such as a water-soluble thiocyanate compound, and the thus-formed silver halide emulsion is continuously withdrawn from the reaction chamber while silver halide grain formation is occurring. During precipitation the halide concentration in the reaction medium is maintained at less than 0.010 molar. The patent states that it is known in the art to prepare silver halide grains in the presence of an excess of silver ions. The patent relates to such a precipitation with the additional steps of continually adding the sulfur-containing ripening agent and continually withdrawing silver halide grains as they are formed.

U.S. Pat. No. 4,150,994 is directed to a method of forming silver iodobromide or iodochloride emulsions which are of the twinned type which comprises the following steps:

(a) forming a monosized silver iodide dispersion;

(b) mixing in the silver iodide dispersion aqueous solutions of silver nitrate and alkali or ammonium bromides or chlorides in order to form twinned crystals;

(c) performing Ostwald ripening in the presence of a silver solvent, such as ammonium thiocyanate, to increase the size of the twinned crystals and dissolve any untwinned crystals;

(d) causing the twinned crystals to increase in size by adding further aqueous silver salt solution and alkali metal or ammonium halide; and (e) optionally removing the water-soluble salts formed and chemically sensitizing the emulsion.

Copending application of Arthur M. Gerber Ser. No. 194,561, filed Oct. 6, 1980 (common assignee) is directed to a method for forming narrow grain size distribution silver halide emulsions by the following steps:

1. Forming photosensitive silver halide grains in the presence of a water-soluble thiocyanate compound with a halide/silver molar ratio ranging from not more than about 5% molar excess of halide to not more than about a 25% molar excess of silver; and 2. Growing said grains in the presence of said water-soluble thiocyanate compound for a time sufficient to grow said grains to a predetermined grain size distribution.

Copending application of Edwin H. Land, Ser. No. 234,937, filed Feb. 17, 1981, (common assignee) is directed to a photosensitive element comprising silver halide grains in a predetermined spaced array and to a method for forming a predetermined spaced array of sites and then forming single effective silver halide grains at said sites. Thus, by forming the sites in a predetermined spatial relationship, if the silver halide grains are formed only at the sites, each of the grains will also be located at a predetermined and substantially uniform distance from the next adjacent grain and their geometric layout will conform to the original configuration of the sites.

The term, "single effective silver halide grain", refers to an entity at each site which functions photographically as a single unit which may or may not be crystallographically a single crystal but one in which the entire unit can participate in electronic and ionic processes such as latent image formation and development.

Copending application Ser. No. 234,937 discloses one method for forming sites by exposing a photosensitive material to radiation actinic to said photosensitive material and developing the so-exposed photosensitive material to provide sites for the generation of silver halide corresponding to the pattern of exposure and then forming photosensitive silver halide grains at the sites. In a preferred embodiment, the sites are provided by the predetermined patterned exposure of a photoresist whereby upon development of the exposed photoresist a relief pattern is obtained wherein the peaks or valleys comprise the above described sites.

Preferably, the photoresist is exposed by interfering coherent radiation in order to provide sites with a desired spacing therebetween. Thus, exposure of the photoresist can be carried out by two interfering coherent beams wherein the beams providing the exposures are at an angle to each other. The intersection of maximum intensities of the two combined exposures will provide a greater degree of modification to the photoresist at the points of intersection than the remainder of the photosensitive material.

Preferably, the source of coherent radiation is a laser. The particular laser will be selected depending upon the absorption spectrum and spectral response characteristics of the specific photoresist employed.

Subsequent to exposure of the photoresist, the relief pattern is formed by developing the exposed photoresist. For example, employing a photoresist wherein solubilization is achieved by exposure, development of the exposed photoresist would result in the removal of selected areas to provide a relief pattern consisting of regular depressions or holes in the photoresist. As disclosed in copending application Ser. No. 234,937, a variety of specific relief configurations can be obtained depending upon the specific material employed and the exposure and developing conditions selected. Copending application of James J. Cowan, Arthur M. Gerber and Warren D. Slafer Ser. No. 234,959, filed Feb. 17, 1981 (common assignee) also discloses and claims methods for producing specific relief patterns.

While the single effective silver halide grains may be formed employing the described relief pattern, it is preferred to replicate the relief pattern by conventional means, for example, by using conventional electroforming techniques to form an embossing master from the original relief image and using the embossing master to replicate the developed photoresist pattern in an embossable polymeric material.

Having produced the described relief pattern, silver halide grains are then formed by a variety of disclosed procedures at the specific sites.

By means of the present invention, a novel method for forming a predetermined spaced array of silver halide grains in a relief pattern has been found.

SUMMARY OF THE INVENTION

The present invention is directed to a photosensitive element comprising a plurality of coalesced single effective silver halide grains in a predetermined spaced array and to a method for forming said grains. The method of the present invention comprises the in situ formation of single effective grains by coalescing fine-grain silver halide in a plurality of predetermined spaced depressions in a surface to provide a single effective silver halide grain in each depression.

DETAILED DESCRIPTION OF THE INVENTION

Figure 1:
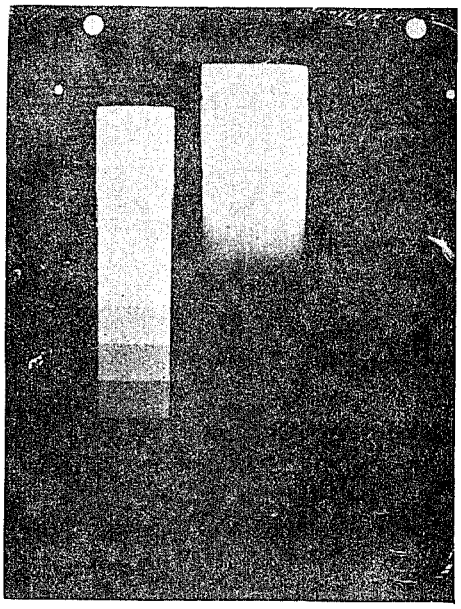
FIG. 1 is an image of a step tablet and continuous wedge obtained from an exposed and processed element prepared by the method of the present invention.

The aforementioned predetermined spaced depressions in a surface comprise a relief pattern which may be formed by the procedures set forth in copending applications Ser. Nos. 234,937 and 234,959 which, in one procedure, provides for coherent light to provide, in a photoresist, selective solubilization which, upon development of the photoresist, will result in a preselected relief pattern of depressions or cup-like formations in a substantially planar surface which is then replicated by procedures set forth therein. The silver halide grains will be formed in each of these depressions and, since the depressions were formed in a predetermined pattern, the resulting silver halide grains will also be arrayed in the same pattern.

A fine-grain silver halide emulsion is applied to the relief pattern in a manner that results in substantially all of the applied emulsion being contained in the aforementioned depressions with little being located between the depressions, e.g., on the planar or plateau-like surface of the photoresist between the depressions. As will be seen below, retention of some grains on the planar surface is not detrimental to the formation of the element, since subsequent operations will deposit most of the silver halide into the depressions. Any fine-grain emulsion remaining on the planar surface subsequent to coalescence is photographically insignificant compared to the silver halide grains formed in the depressions.

The term, "fine-grain emulsion", as used herein is intended to refer to a silver halide emulsion containing grains the size of which would permit a number of grains to be deposited within each depression and also sufficiently small to substantially conform to the contours of the depressions. Preferably, a silver halide emulsion containing grains between about 0.01 and 0.50 $\mu$m in diameter is employed. Particularly preferred is a silver halide emulsion having a grain size with an average diameter of about 0.1 $\mu$m or less.

Since the silver halide grains must be kept in suspension prior to depositing them in the depressions, there is a polymeric binder material, generally gelatin, also present. It is preferred that the binder to silver ratio be relatively low since an excessive amount of binder such as gelatin may slow or inhibit the subsequent single grain formation. In addition, excessive binder would occupy space in the depressions that could be taken by silver halide grains. Preferably, the gel to silver ratio is about 0.10 or less and more preferably about 0.075. It is also preferred that the fine-grain emulsion be dried in the depressions prior to the next processing step so that subsequent processing steps will not result in the displacement or loss of the fine-grain silver halide emulsion from the depressions.

It is also preferred that surfactants be employed to facilitate coating of the emulsion in the depressions. In a preferred embodiment, the surfactants comprise a combination of AEROSOL OT (dioctyl ester of sodium sulfosuccinic acid) American Cyanamid Co., Wayne, N.J., and MIRANOL J2M-SF (dicarboxcylic caprylic derivative sodium salt) Miranol Chemical Co., Inc., Irvington, N.J., in a 1 to 3 ratio by weight, respectively, at about a 0.1% concentration by weight, based on the weight of the emulsion.

The term "coalescence" is used herein in the broad sense and is intended to refer to the total process involving the formation of the single effective silver halide grains and it is intended to include both Ostwald ripening and coalescence ripening.

Subsequent to the deposition of the fine-grain emulsion in the depressions, coalescence of the grains into single effective silver halide grains is accomplished. Preferably, a solution of silver halide solvent is so applied that in each depression there occurs a concomitant partial dissolution of the original fine grains and redeposition to form a single larger grain therein. Sufficient solvent concentration must be employed to achieve suitable single effective grain formation as determined by photographic performance but an excessive concentration should be avoided so that the fine-grain emulsion will not be removed from the depressions. While the application of fine-grain emulsion to the depressions and subsequent coalescence will result in single effective grain formation it should be understood that some depressions may be without a grain or contain a plurality of grains because of defects in the relief pattern or nonuniformities in the application of the fine-grain emulsion, or incomplete coalescence.

While not intending to be bound by theory, it is believed that single effective grain formation takes place through a combination of Ostwald ripening and coalescence ripening. (See pgs. 93–94, T. H. James, *The Theory of the Photographic Process*, 4th Edition, MacMillan Publishing Co., 1977).

The single effective grains can be prepared in a variety of crystal structures, for example, flat plates, or clusters of fused silver halide subunits.

The specific ratio of silver halide solvent to fine-grain emulsion is determined empirically depending upon the size of the depressions and quantity of fine-grain emulsion deposited therein.

Any suitable silver halide solvent known to the art and combinations thereof may be employed in the practice of the present invention. As examples of such solvents mention may be made of the following: soluble halide salts, e.g., lithium bromide, potassium bromide, lithium chloride, potassium chloride, sodium bromide, sodium chloride; sodium thiosulfate, sodium sulfate, ammonium thiocyanate, potassium thiocyanate, sodium thiocyanate; thioethers such as thiodiethanol; ammonium hydroxide, organic silver complexing agents, such as ethylene diamine and higher amines. In a preferred embodiment, ammonium thiocyanate is employed.

Copending application of Edwin H. Land and Vivian K. Walworth, Ser. No. 298,638 filed concurrently herewith (common assignee), discloses and claims a method of coalescence wherein the silver halide solvent, e.g., ammonium thiocyanate solution, contains a dissolved silver salt, for example, silver bromide, silver chloride or silver thiocyanate.

Copending application of Vivian K. Walworth, Ser. No. 298,637, filed concurrently herewith (common assignee), discloses and claims a method of coalescence employing a silver halide solvent in the vapor phase.

For ease of application a small amount of polymeric binder material, preferably gelatin, may be employed in the solution of silver halide solvent. Suitable amounts of binder range from about 0 to 10% by weight based on the weight of the solution.

Subsequent to the addition of the silver halide solvent, the plurality of fine silver halide grains in the depressions is coalesced into a single effective grain in each depression. Preferably, such coalescence is carried out by the application of heat to accelerate the coalescence.

To insure that coalescence of the grains occurs only in the depressions, and to control the amount of silver halide solvent in each depression, a cover sheet which conforms to the planar or plateau-like surface of the relief pattern is preferably employed. After heating the partially dissolved grains, an optional cooling step is also preferred prior to removing the cover sheet in order to further assist the coalescence of the fine-grain emulsion into single effective grains in each depression. Evaporation of the carrier liquid from the solvent may occur during coalescence, but it is not necessary for single effective grain formation.

After removal of the cover sheet, a relief pattern containing a predetermined spaced array of depressions, each carrying a single effective silver halide grain, is obtained.

The small amount of fine-grain silver halide emulsion referred to above which is initially located on the planar surfaces is generally deposited into the depressions by the application of the silver halide solvent solution since the solvent solution contacts the emulsion on the planar surfaces first. Even after coalescence some grains may remain on the planar surface but compared to the single effective grain formed in each depression they are photographically insignificant.

Preferably, the solution of silver halide solvent is applied to a nip formed by the cover sheet and the emulsion-carrying depressions and the thus-formed laminate is passed through pressure-applying rollers.

Copending application of Arthur M. Gerber, Warren D. Slafer, and Vivian K. Walworth, Ser. No. 298,639 filed concurrently (common assignee) discloses and claims a process which employs a cover sheet comprising a layer of a hydrophilic polymer, such as gelatin, in contact with a relief pattern comprising a hydrophobic material during or subsequent to coalescence whereby the single effective grains are retained on the hydrophilic layer after separation.

Preferably, spectral sensitization of the photosensitive elements of the present invention may be achieved by applying a solution of a spectral sensitizing dye to the thus-formed single effective silver halide grains. This is accomplished by applying a solution of a desired spectral sensitizing dye to the finished element. However, the sensitizing dye may be added at any point during the process, including with the fine-grain emulsion or silver halide solvent solution. In a preferred embodiment, the spectral sensitizing dye solution contains a polymeric binder material, preferably gelatin.

A comparison of silver coverages of the initially deposited fine-grain emulsion and the final single effective silver halide grains show that substantially all the silver initially deposited remains after carrying out the procedure of the present invention.

The following Examples illustrate the novel process of the present invention.

EXAMPLE 1

A fine-grain silver iodobromide emulsion (4 mole % I, gelatin/Ag ratio of 0.075, grain diameter about 0.1 μm) was coated with a wire-wound coating rod onto a polyester base carrying a layer of cellulose acetate butyrate embossed with depressions about 1.8 μm in diameter, depth about 1 μm with center-to-center spacing of about 2.2 μm to provide a silver coverage of about 80 mg/ft$^2$. The emulsion contained a 1 to 3 ratio, by weight, of AEROSOL OT and MIRANOL J2M-SF, respectively, at about a 0.1% concentration, by weight, based on the weight of the emulsion, to facilitate coating. The emulsion-coated embossed base was then dried.

The emulsion-coated embossed base was overlaid with a layer of 25 mg/ft$^2$ of gelatin carried on a subcoated 4 mil cellulose triacetate support and passed through rubber rollers with pressure applied thereto while a silver halide solvent solution was applied to the nip formed by the emulsion-coated embossed base and the gelatin-coated cover sheet. The silver halide solvent solution comprised 6% ammonium thiocyanate, 0.5% silver (as silver bromide, dissolved) and 1% gelatin.

The thus-formed lamination was heated for 1 min. at 85° C. and then cooled for about 2 min. at about −20° C. and the gelatin-coated cover sheet was detached from the embossed base.

The thus-formed spaced array of grains on the gelatin-coated cover sheet was then exposed to a step tablet and continuous wedge at 2 mcs and processed with a Type 42 processing composition and Type 107C receiving sheet (Polaroid Corp., Cambridge, Mass.). The positive silver transfer image of the step tablet and continuous wedge is shown in FIG. 1.

EXAMPLE 2

Figure 2:
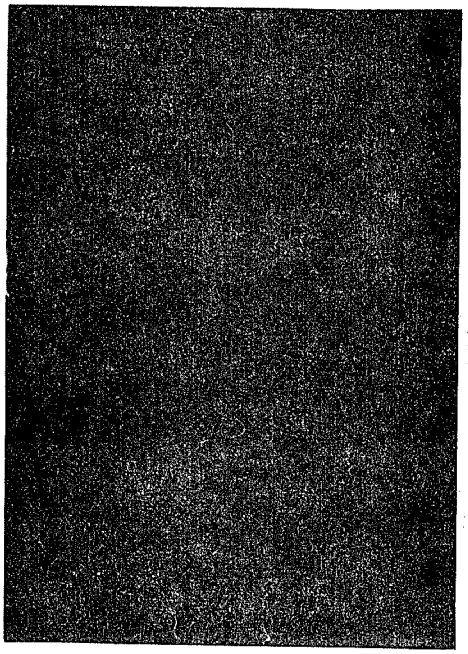
FIG. 2 is a control for comparison with FIG. 1.

As a control, the procedure of Example 1 was repeated except that no silver halide solvent solution was employed. FIG. 2 shows the photographic results obtained after processing. The total lack of a positive image at this exposure level (2 mcs) indicates that, since no coalescence was carried out, the fine-grain silver halide emulsion without coalescence showed substantially no visible photographic response whereas, following coalescence of the same emulsion, as shown in Example 1, a significant photographic response is achieved.

EXAMPLE 3

A fine-grain silver iodobromide emulsion (4 mole % I, gelatin/Ag ratio of 0.075, grain diameter about 0.1 μm) was slot-coated onto a polyester base carrying a layer of cellulose acetate butyrate embossed with depressions about 1.8 μm in diameter, about 1 μm in depth with center-to-center spacing of about 2.2 μm. The emulsion contained surfactants as described in Example 1 to facilitate coating. The emulsion-coated embossed base was then dried.

Figure 3:
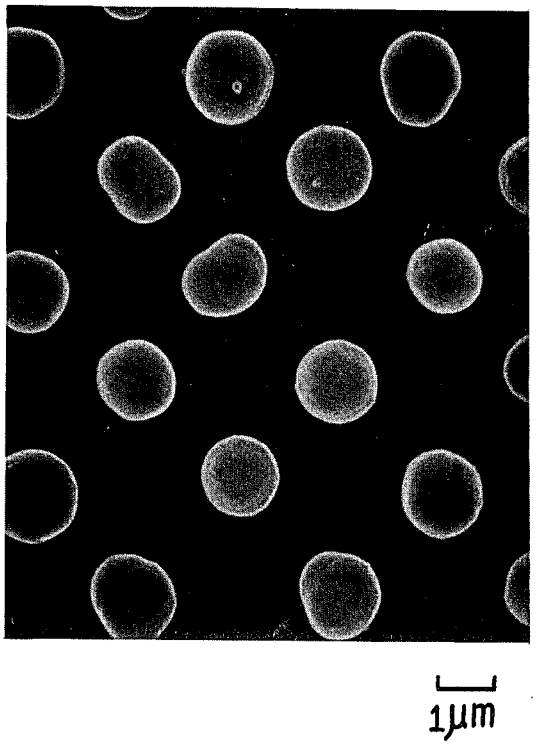
FIG. 3 is an electron micrograph of an element prepared by the method of the present invention.

The emulsion-coated embossed base was overlaid with a layer of 25 mg/ft$^2$ of gelatin carried on a subcoated cellulose triacetate support and passed through rubber rollers with pressure applied thereto while a silver halide solvent solution was applied to the nip formed by the emulsion-coated embossed base and the gelatin-coated cover sheet. The silver halide solvent solution comprised 4% ammonium thiocyanate, 14.6% potassium bromide and 1% gelatin. The thus-formed lamination was heated for 1 min. at 85° C. and then cooled for about 2 min. at about −20° C. and then the gelatin cover sheet was detached from the embossed base. A regular spaced array of plate-like silver halide grains was observed on the gelatin layer. FIG. 3 is an electron micrograph at 10,000× magnification showing the gelatin layer and the grains contained thereon.

EXAMPLE 4

A fine-grain silver iodobromide emulsion (4 mole % I, gelatin/Ag ratio of 0.075, grain diameter about 0.1 μm) was slot-coated onto a polyester base carrying a layer of cellulose acetate butyrate embossed with depressions about 1.8 μm in diameter, about 1 μm in depth with center-to-center spacing of about 2.2 μm. The emulsion contained surfactants as described in Example 1 to facilitate coating. The emulsion-coated embossed base was then dried.

A silver halide solvent solution was prepared by adding 1 g of silver thiocyanate to 200 ml of a 9% ammonium thiocyanate solution in water, and heating the resulting mixture to 50° C. for about 15 min. The mixture was then cooled to 25° C. and the excess silver thiocyanate was removed by filtering with a 0.2 μm filter, and the filtrate was diluted 1:1 by volume with a 2% gelatin solution.

Figure 4:
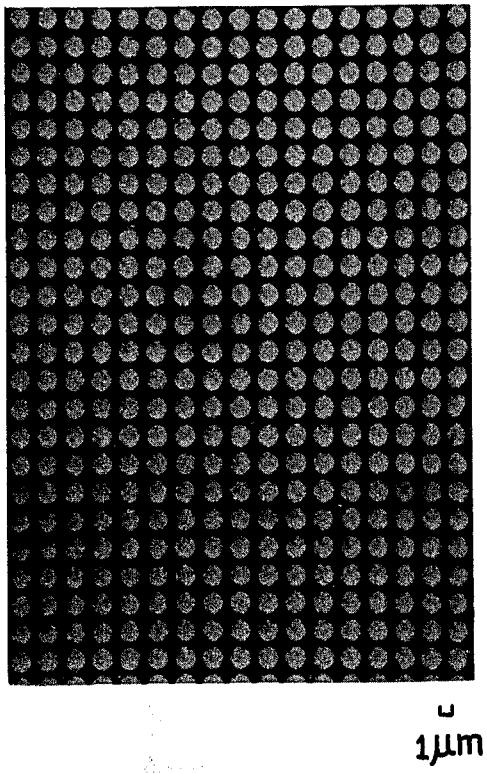
FIG. 4 is an electron micrograph of an element prepared by the method of the present invention.

The emulsion-coated embossed base was overlaid with a layer of 25 mg/ft$^2$ of gelatin carried on a subcoated cellulose triacetate support and passed through rubber rollers with pressure applied thereto while the silver halide solvent solution was applied to the nip formed by the emulsion-coated embossed base and the gelatin-coated cover sheet. The thus-formed lamination was heated for 2 min. at 67° C. and then cooled for about 2 min. at about −20° C. and then the gelatin-coated cover sheet was detached from the embossed base. A regular spaced array of silver halide grains about 1.8 μm in diameter was observed on the gelatin layer. FIG. 4 is an electron micrograph at 2,000× magnification showing the gelatin layer and the grains contained thereon.

EXAMPLE 5

Figure 5:
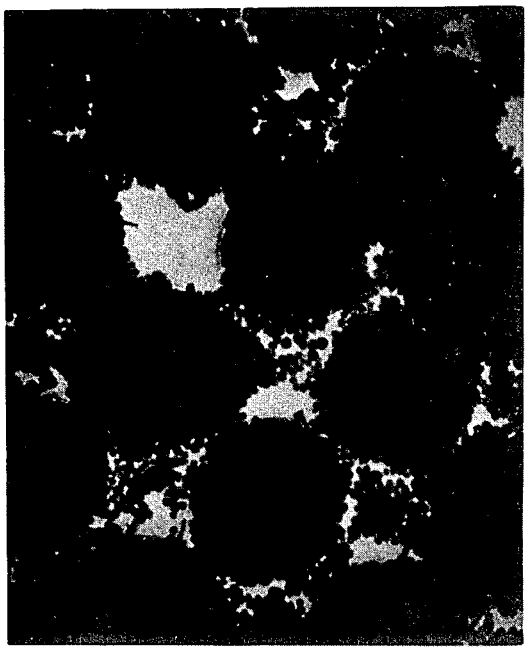
FIG. 5 is an electron micrograph showing an intermediate stage of the method of the present invention.

A fine-grain silver iodobromide emulsion (4 mole % I, gelatin/Ag ratio of 0.05, grain diameter about 0.1 μm) was slot-coated onto a polyester base carrying a layer of cellulose acetate butyrate embossed with depressions about 0.9 μm in diameter, about 0.9 μm in depth with center-to-center spacing of about 1.2 μm. The emulsion contained surfactants as described in Example 1 to facilitate coating. The emulsion-coated embossed base was then dried. The silver coverage was about 80 mg/ft$^2$. FIG. 5 is a scanning transmission electron micrograph at 20,000× magnification showing the emulsion-coated embossed base.

Figure 6:
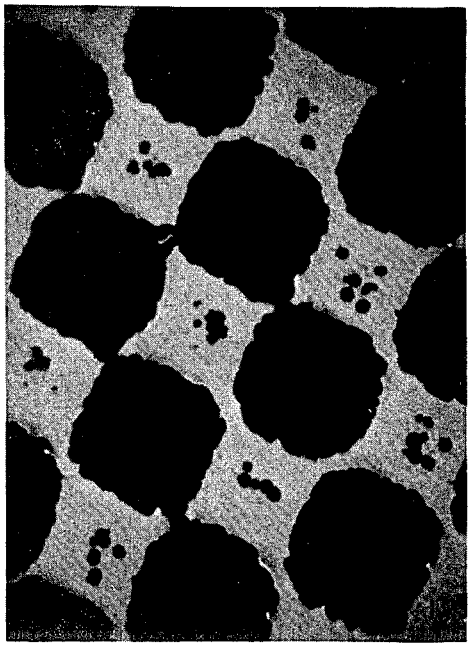
FIG. 6 is an electron micrograph showing the element of FIG. 5 after the method of the present invention was carried out.
Figure 7:
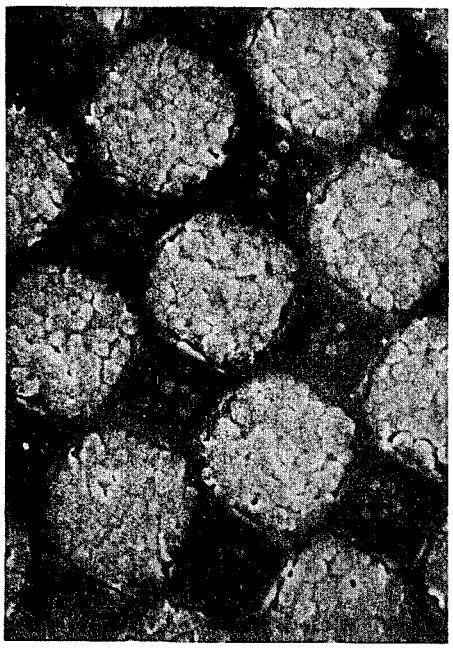
FIG. 7 is an electron micrograph showing a different view of the element shown in FIG. 6.
Figure 8:
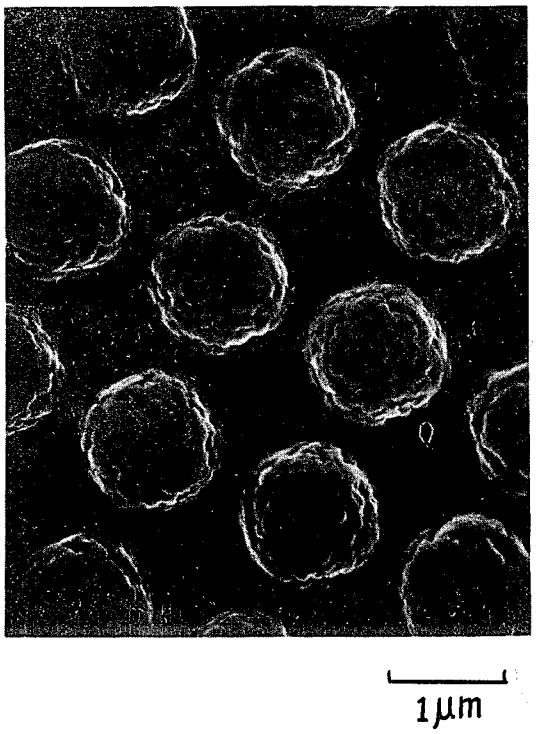
FIG. 8 is an electron micrograph of the element of FIG. 7 from another view after the base had been dissolved away.
Figure 9:
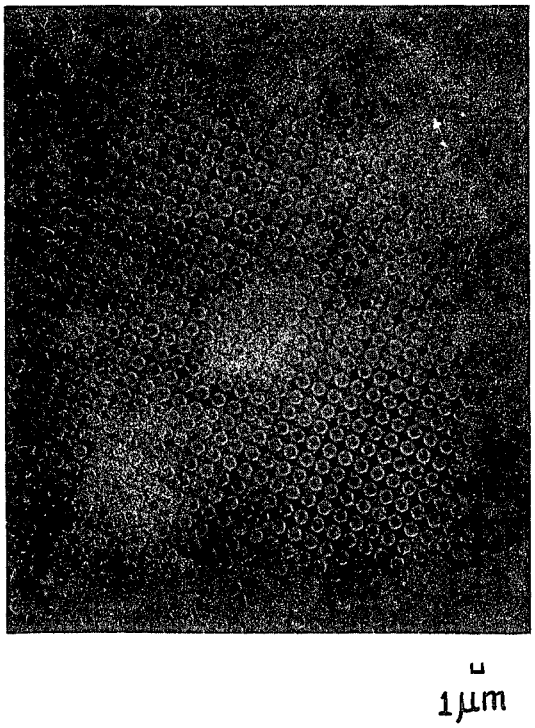
FIG. 9 is an electron micrograph of the grains described in FIG. 8 at a different magnification.

The emulsion-coated embossed base was overlaid with a 4 mil unsubbed cellulose acetate butyrate cover sheet and passed through rubber rollers with pressure applied thereto while a silver halide solvent solution was applied to the nip formed by the emulsion-coated embossed base and the cover sheet. The silver halide solvent solution comprised a 5% ammonium thiocyanate solution in water, saturated with silver thiocyanate, and 1% gelatin. The thus-formed lamination was heated for about 2 min. at about 67° C. and then cooled for about 2 min. at about −20° C. and then the cover sheet was detached from the embossed base. The embossed base with the coalesced silver halide grains contained therein was again covered with a cellulose acetate butyrate cover sheet as described above and passed through rollers gapped at 0.0004 in. while an aqueous solution of sensitizing dye (4% gelatin and 1% anhydro-9-methyl-3,3'-di-β-disulfopropylthiacarbocyanine hydroxide) was applied to the nip formed by the embossed base and the cover sheet. After a 5 min. imbibition period the cover sheet was detached. This procedure both spectrally sensitized and removed excess salts. FIG. 6 is a scanning transmission electron micrograph at 20,000× magnification of the grains after the sensitization step. A few residual fine grains will be seen on the planar surface between the single effective grains. FIG. 7 is a scanning electron micrograph at 20,000× magnification of the same grains after sensitization viewed from above. Again, a few residual fine grains are visible on the planar surface. FIG. 8 is a scanning electron micrograph at 20,000× magnification of the grains after spectral sensitization viewed from the bottom after the base had been dissolved away. FIG. 9 is the same view of the grains as in FIG. 8 except at 2,000× magnification to show the array of grains.

The following Examples show the effect of a silver halide solvent at different concentrations:

EXAMPLE 6

Figure 10:
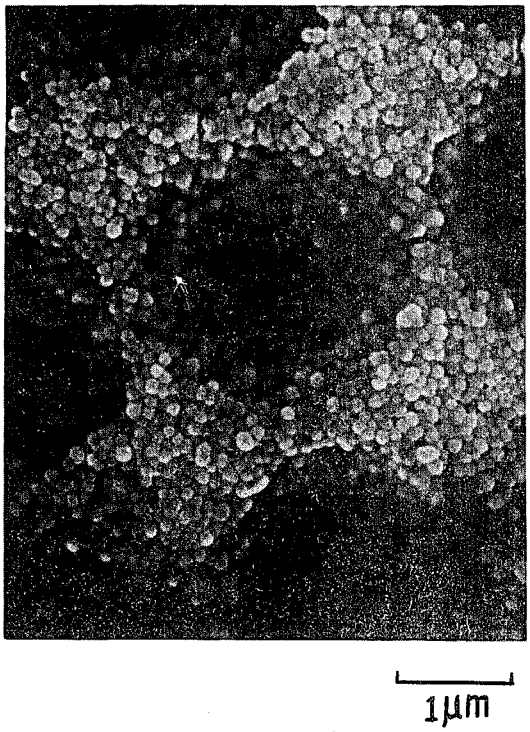
FIG. 10 is an electron micrograph showing an intermediate stage of the method of the present invention.

A fine-grain silver iodobromide emulsion (4 mole % I, gelatin/Ag ratio of 0.075, grain diameter about 0.1 μm) was slot-coated onto a polyester base carrying a layer of cellulose acetate butyrate embossed with depressions about 1.8 μm in diameter, about 1 μm in depth with center-to-center spacing of about 2.2 μm. The emulsion contained surfactants as described in Example 1 to facilitate coating. The emulsion-coated embossed base was then dried. The silver coverage was about 80 mg/ft$^2$. FIG. 10 is a scanning electron micrograph, top view, at 20,000× magnification showing the emulsion-coated embossed base.

Three silver halide solvent aqueous solutions were prepared:

(A) 4% ammonium thiocyanate; 1% gelatin.

(B) 6% ammonium thiocyanate; 1% gelatin.

(C) 8% ammonium thiocyanate; 1% gelatin.

Three sections of emulsion-coated embossed base were overlaid with a layer of 25 mg/ft$^2$ of gelatin carried on a subcoated cellulose triacetate support and passed through rubber rollers with pressure applied thereto while the indicated silver halide solvent solutions were applied to the nip formed by the emulsion-coated embossed base and the gelatin-coated cover sheet. The thus-formed laminations were heated by immersion in water for 2 min. at 85° C. and then cooled for about 1 min. at about −20° C. and then the gelatin-coated cover sheets were detached from the embossed base.

Figure 11:
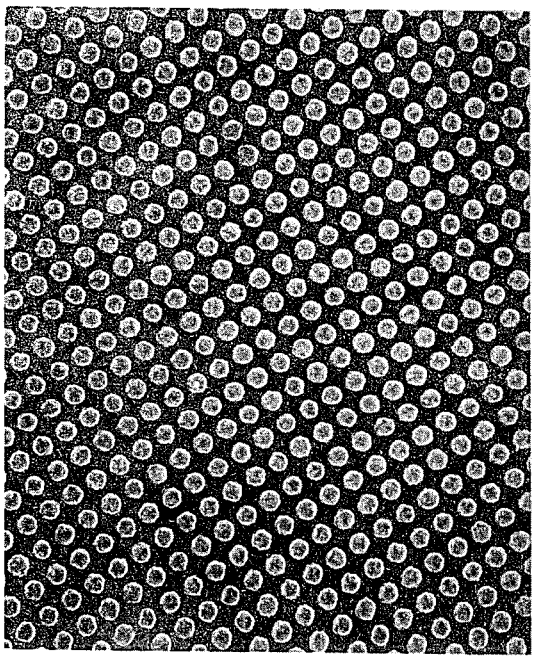
FIG. 11 is an electron micrograph of an element prepared using a first concentration of silver halide solvent solution.
Figure 12:
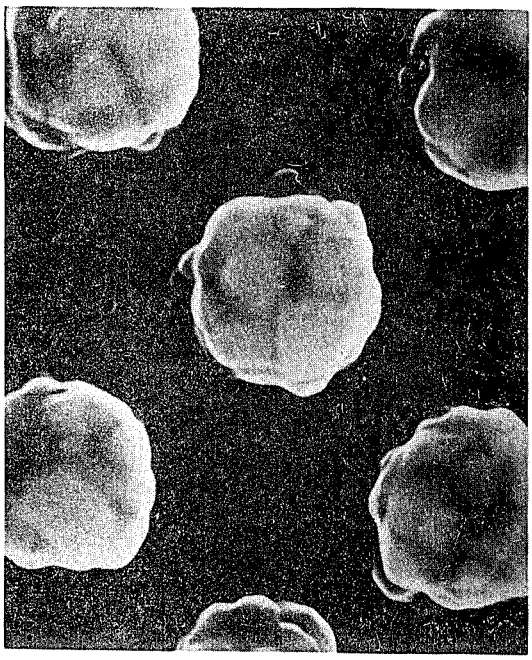
FIG. 12 is an electron micrograph at a different magnification on the element shown in FIG. 11.

The single effective grains formed using silver halide solvent solution A is shown in FIG. 11, which is a scanning electron micrograph of coalesced and transferred grains at 2,000× magnification. FIG. 12, a scanning electron micrograph at 20,000× magnification, shows a quantity of fine-grain emulsion on the planar surfaces intermediate the single effective grains, indicating that silver halide solvent solution A was not concentrated enough to provide a silver halide solvent to silver halide ratio sufficient to dissolve the fine-grain emulsion on the planar surfaces and carry it into the depressions.

Figure 13:
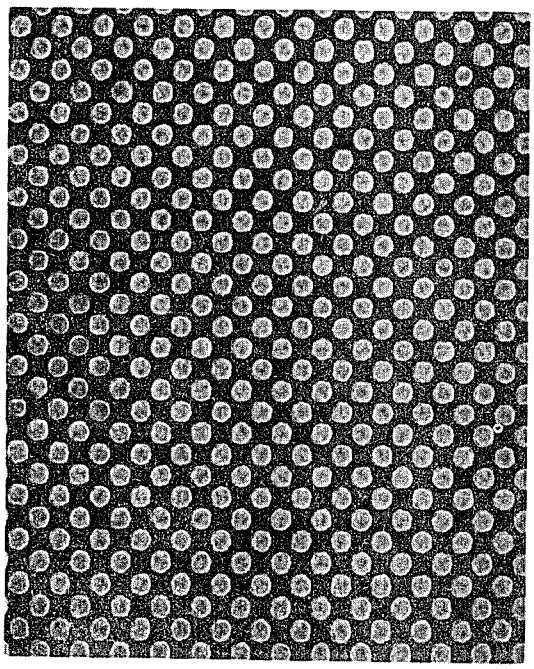
FIG. 13 is an electron micrograph of an element prepared using a second concentration of silver halide solvent solution.
Figure 14:
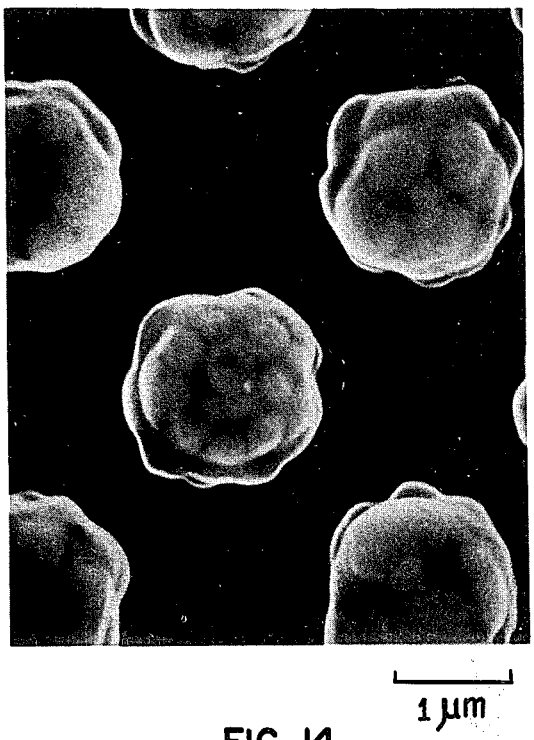
FIG. 14 is an electron micrograph at a different magnification of the element shown in FIG. 13.

The single effective grains formed using silver halide solvent solution B is shown in FIGS. 13 and 14. FIG. 13 is a scanning electron micrograph at 2,000× magnification showing the array of grains and FIG. 14 is a scanning electron micrograph at 20,000× magnification. It will be noted that the crystals are well formed and very little fine-grain emulsion on the planar surface is visible, indicating substantially optimum solvent solution concentration and coalescence.

Figure 15:
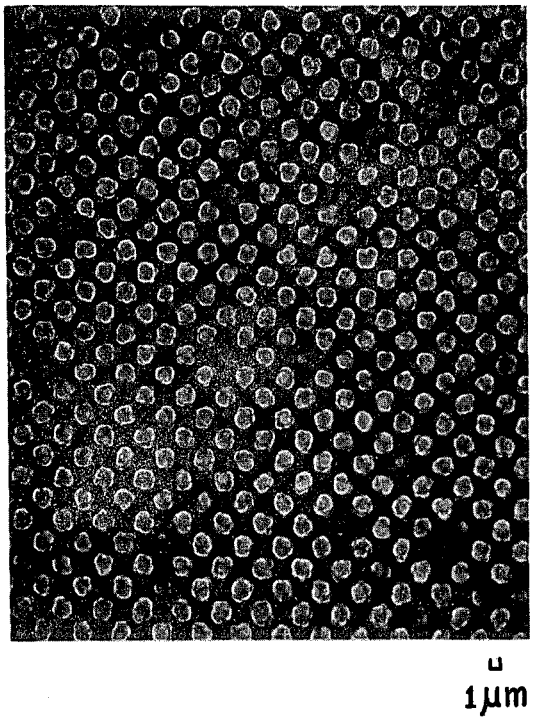
FIG. 15 is an electron micrograph of an element prepared using a third concentration of silver halide solvent solution.
Figure 16:
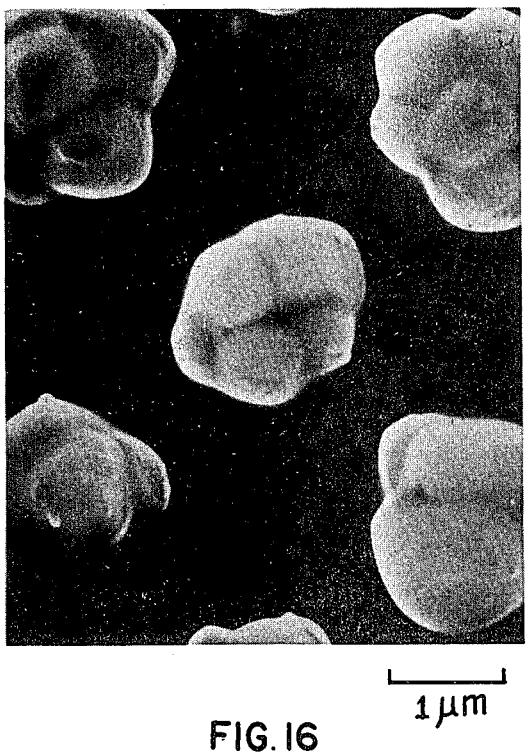
FIG. 16 is an electron micrograph at a different magnification of the element shown in FIG. 15.

The single effective silver halide grains formed using silver halide solvent solution C is shown in FIGS. 15 and 16. FIG. 15, a scanning electron micrograph at 2,000× shows grains partially dissolved away indicating that the concentration of silver halide solvent solution was excessive in the amount applied. FIG. 16, a scanning electron micrograph at 20,000× magnification, shows silver halide grains smaller than those observed in FIG. 14, indicating that some silver halide has been lost. A further increase in solvent solution concentration beyond that employed in solution C would result in loss of a greater amount of silver halide.

EXAMPLE 7

A fine-grain silver iodobromide emulsion (4 mole % I, gelatin/Ag ratio of 0.075, grain diameter about 0.1 μm) was slot-coated onto a polyester base carrying a layer of cellulose acetate butyrate embossed with depressions about 1.8 μm in diameter, about 1 μm in depth with center-to-center spacing of about 2.2 μm. The emulsion contained surfactants as described in Example 1 to facilitate coating. The emulsion-coated embossed base was then dried. The silver coverage was about 80 mg/ft$^2$.

The emulsion-coated embossed base was overlaid with a layer of 25 mg/ft$^2$ of gelatin carried on a subcoated cellulose triacetate support and passed through rubber rollers with pressure applied thereto while a silver halide solvent solution was applied to the nip formed by the emulsion-coated embossed base and the gelatin-coated cover sheet. The silver halide solvent solution comprised a 4.5% ammonium thiocyanate and 1% gelatin in water. The thus-formed lamination was heated for 2 min. at 67° C. and then cooled for about 2 min. at about −20° C. and then the gelatin-coated cover sheet was detached from the embossed base. A regular spaced array of silver halide grains was evident on the gelatin layer. The grains were removed from the layer for microscopic examination by enzyming the gelatin.

Figure 17:
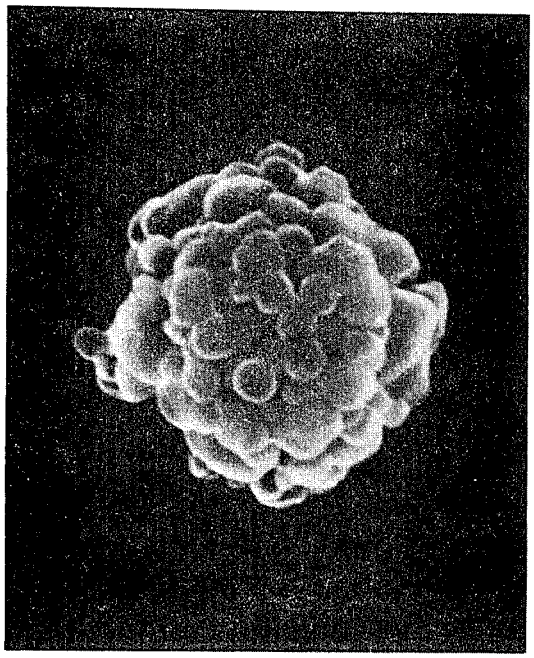
FIG. 17 is an electron micrograph of a single effective grain prepared by the method of the present invention.
Figure 18:
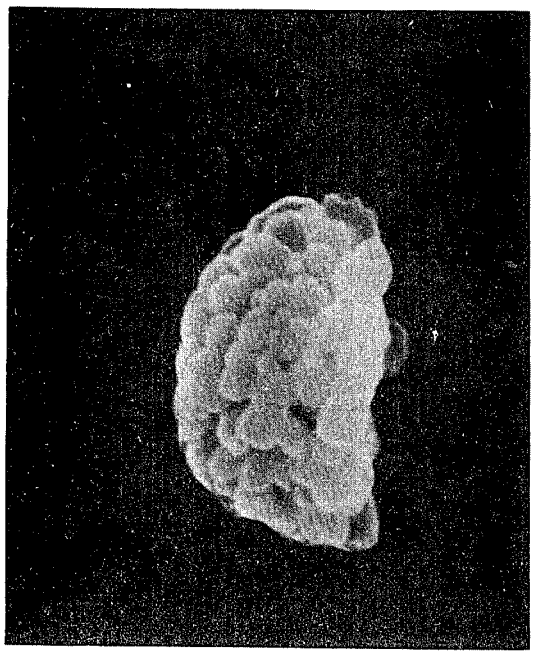
FIG. 18 is an electron micrograph of another view of the grain shown in FIG. 17.

FIG. 17 is a scanning electron micrograph at 30,000× magnification of a top view of a grain and FIG. 18 is a scanning electron micrograph at 30,000× magnification of a side view of a grain.

The following Example shows that the grains prepared by the procedure of the present invention are single effective grains and are acting as an array.

EXAMPLE 8

A fine-grain silver iodobromide emulsion (4 mole % I, gelatin/Ag ratio of 0.075, grain diameter about 0.1 μm) was slot-coated onto a polyester base carrying a layer of cellulose acetate butyrate embossed with depressions about 1.8 μm in diameter, about 1 μm in depth with center-to-center spacing of about 2.2 μm. The emulsion contained surfactants as described in Example 1 to facilitate coating. The emulsion-coated embossed base was then dried.

The emulsion-coated embossed base was overlaid with a layer of 25 mg/ft$^2$ of gelatin carried on a subcoated cellulose triacetate support and passed through rubber rollers with pressure applied thereto while a silver solvent solution was applied to the nip formed by the emulsion-coated embossed base and the gelatin-coated cover sheet. The silver halide solvent solution comprised 5% ammonium thiocyanate, 1% gelatin, saturated with silver thiocyanate. The thus-formed lamination was immersed in 85° C. water for 1 min., cooled for about 2 min. at about −20° C. and then the gelatin-coated cover sheet was detached from the embossed base. A regular spaced array of silver halide grains about 1.8 μm in diameter was evident in the gelatin layer.

The grains were chemically sensitized by immersion in a solution containing a gold thiocyanate complex and sodium thiosulfate, 1% gelatin at a pAg of 7.0 and a pH of 6.3, for 2 min. at 54° C. The grains were spectrally sensitized by immersion in a solution of the panchromatic sensitizing dye (1 mg/ml) described in Example 5 and 1% gelatin for 1 minute at room temperature. The layer was dried, exposed to a step tablet and continuous wedge at 2 mcs and processed with a Type 42 processing composition and Type 107C receiving sheet (Polaroid Corporation, Cambridge, Mass.) with an imbibition period of about 1 min. The positive and negative sheets were then separated.

Figure 19:
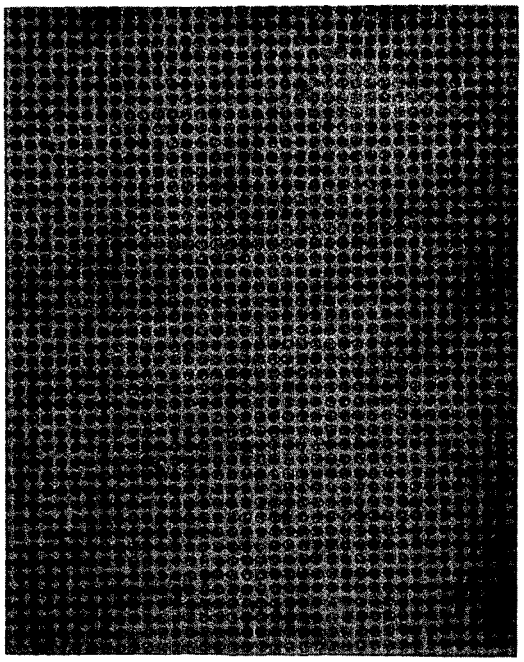
FIG. 19 is an optical micrograph of an element prepared by the method of the present invention.
Figure 20:
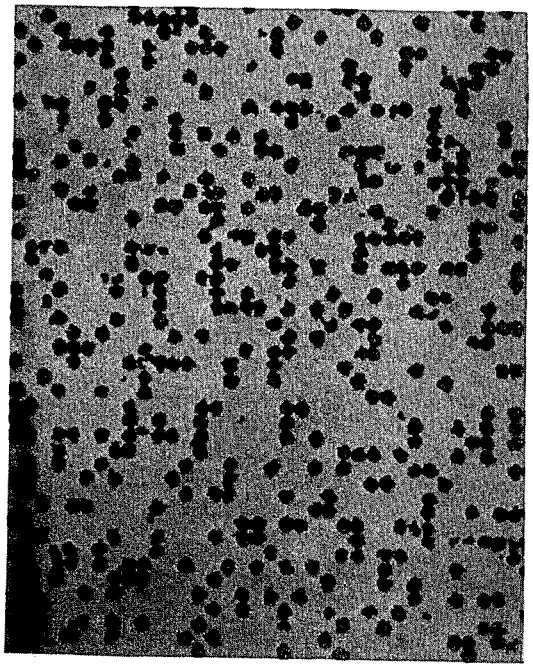
FIG. 20 is an optical micrograph showing an area of the exposed and processed element of FIG. 19 in which approximately $\frac{1}{3}$ of the grains have been developed.

FIG. 19 is an optical micrograph at 1,000+ magnification of the element of the present invention prior to processing. FIG. 20 is an optical micrograph at 1,000× of the element of FIG. 19 after processing showing the negative in a low exposure area, wherein the density is about 0.2. It will be seen in FIG. 20 that the grains are single effective grains and they are in an array. The incidence of development of adjacent grains is of the order expected due to the random arrival of photons.

Figure 21:
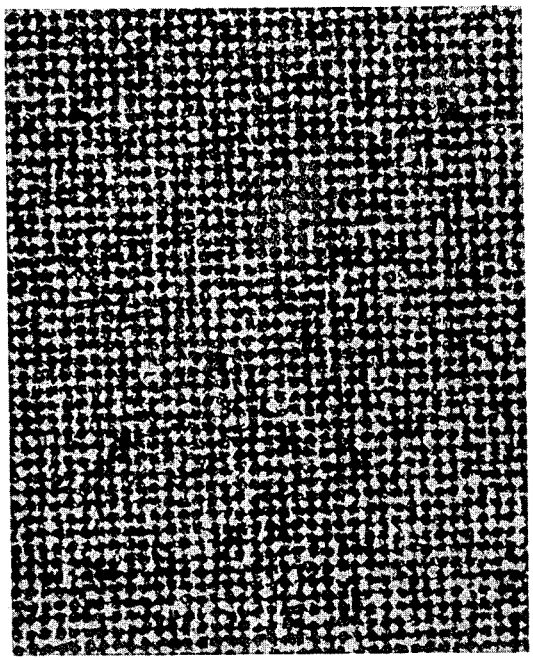
FIG. 21 is an optical micrograph showing an area of maximum exposure of the exposed and processed element of FIG. 19.

FIG. 21 is an optical micrograph at 1,000× of the element of FIG. 19 after processing showing the negative in an area of maximum exposure wherein the density is about 0.6. The individual grains and the array are apparent in FIG. 21 showing that the grains are single effective grains and are acting as an array throughout the entire photoresponsive range.

The photographic element of the present invention may be chemically sensitized by conventional sensitizing agents known to the art and which may be applied at substantially any stage of the process, e.g., during or subsequent to coalescence and prior to spectral sensitization.

Spectral sensitization of the photosensitive elements of the present invention may be achieved by applying a solution of a spectral sensitizing dye to the thus-formed single effective silver halide grains. This is accomplished by applying a solution of a desired spectral sensitizing dye to the finished element. In a preferred embodiment, the spectral sensitizing dye solution contains a polymeric binder material, preferably gelatin.

Additional optional additives, such as coating aids, hardeners, viscosity-increasing agents, stabilizers, preservations, and the like, also may be incorporated in the emulsion formulation.

What is claimed is:

1. A method for forming a photosensitive element comprising a plurality of single effective silver halide grains in a predetermined spaced array which comprises coalescing fine-grain silver halide in a polymeric binder material in a plurality of predetermined spaced depressions in a surface.

2. The method of claim 1 wherein said spaced depressions are in a planar surface.

3. The method of claim 1 which includes the step of depositing said fine-grain silver halide in said spaced depressions.

4. The method of claim 1 wherein said fine-grain silver halide is a fine-grain silver halide emulsion.

5. The method of claim 4 wherein said fine-grain emulsion comprises silver halide grains about 0.01 to 0.50 μm in average diameter.

6. The method of claim 5 wherein said fine-grain emulsion comprises grains about 0.1 μm or less in diameter.

7. The method of claim 4 wherein said fine-grain emulsion has a binder to silver ratio of about 0.10 or less.

8. The method of claim 7 wherein said binder to silver ratio is about 0.075.

9. The method of claim 4 wherein said coalescence is carried out by the partial dissolution of the silver halide grains in each of said depressions.

10. The method of claim 9 wherein said partial dissolution is carried out by the application of a solution of silver halide solvent.

11. The method of claim 10 wherein said silver halide solvent is ammonium thiocyanate.

12. The method of claim 10 wherein said silver halide solvent is ammonium thiocyanate and potassium bromide.

13. The method of claim 10 wherein said solution of silver halide solvent includes a polymeric binder material.

14. The method of claim 13 wherein said polymeric binder material is gelatin.

15. The method of claim 10 wherein said coalescence includes the application of heat.

16. The method of claim 15 which includes the step of cooling subsequent to said application of heat.

17. The method of claim 9 wherein a cover sheet is superposed over said depressions during coalescence.

18. The method of claim 17 wherein said cover sheet is removed subsequent to said coalescence.

19. A method for forming a photosensitive element comprising a plurality of single effective silver halide grains in a predetermined spaced array which comprises the following steps in sequence:

(a) depositing a fine-grain silver halide emulsion in a plurality of predetermined spaced depressions in a surface;

(b) applying a solution of silver halide solvent in an amount sufficient to partially dissolve said silver halide grains in each depression; and (c) coalescing said silver halide grains to a single effective silver halide grain in substantially each depression.

20. The method of claim 19 which includes the step of applying a cover sheet over said depressions substantially contemporaneously with the application of said solution of silver halide solvent.

21. The method of claim 19 wherein said solution of silver halide solvent is disposed in a nip formed by a cover sheet and said depressions and applying pressure to said cover sheet and the element comprising said depressions.

22. The method of claim 21 wherein said pressure is applied by passing said cover sheet and the element comprising said depressions between pressure applying rollers.

23. The method of claim 19 wherein said coalescence includes the application of heat.

24. The method of claim 23 which includes the step of cooling subsequent to said application of heat.

25. The method of claim 20 wherein said cover sheet is removed subsequent to said coalescence.

26. The method of claim 19 wherein said fine-grain emulsion comprises silver halide grains about 0.01 to 0.50 μm in average diameter.

27. The method of claim 26 wherein said fine-grain emulsion comprises grains about 0.1 μm or less in diameter.

28. The method of claim 19 wherein said fine-grain emulsion has a binder to silver ratio of about 0.10 or less.

29. The method of claim 28 wherein said binder to silver ratio is about 0.075.

30. The method of claim 19 wherein said silver halide solvent is ammonium thiocyanate.

31. The method of claim 19 wherein said silver halide solvent comprises ammonium thiocyanate and potassium bromide.

32. The method of claim 19 wherein said solution of silver halide solvent includes a polymeric binder material.

33. The method of claim 32 wherein said polymeric binder material is gelatin.

34. A photosensitive element comprising a predetermined spaced array of coalesced single effective silver halide grains in a plurality of predetermined spaced depressions in a surface.

35. The element of claim 34 wherein each of said grains is a flat plate.

36. The element of claim 34 wherein each of said grains comprises clusters of fused silver halide subunits.

* * * * *